US011253887B1

(12) United States Patent
Hung

(10) Patent No.: US 11,253,887 B1
(45) Date of Patent: Feb. 22, 2022

(54) CAULKING GUN

(71) Applicant: SIANG SYUAN FU ENTERPRISE CO., LTD., Changhua County (TW)

(72) Inventor: Chen-Hsuan Hung, Changhua County (TW)

(73) Assignee: SIANG SYUAN FU ENTERPRISE CO., LTD., Changhua County (TW)

( * ) Notice: Subject to any disclaimer, the term of this patent is extended or adjusted under 35 U.S.C. 154(b) by 0 days.

(21) Appl. No.: 17/158,607

(22) Filed: Jan. 26, 2021

(51) Int. Cl.
*B05C 17/005* (2006.01)
*B05C 17/01* (2006.01)

(52) U.S. Cl.
CPC ..... *B05C 17/0123* (2013.01)

(58) Field of Classification Search
CPC ..... B05C 17/0123; B05C 17/01; F16N 3/12
See application file for complete search history.

(56) References Cited

U.S. PATENT DOCUMENTS 2,732,102 A * 1/1956 Ekins ..... B05C 17/0123 222/327
3,110,310 A * 11/1963 Cislak ..... B05C 17/0123 604/209
6,089,412 A * 7/2000 Snell ..... B05C 17/01 222/214
10,016,781 B2 * 7/2018 Poppe ..... B05C 17/0126
10,668,498 B1 * 6/2020 Hung ..... B05C 17/0123
2001/0013526 A1 * 8/2001 Keller ..... B05C 17/0126 222/327
2008/0083790 A1 * 4/2008 Tseng ..... B05C 17/0123 222/391
2013/0161361 A1 * 6/2013 Szpak ..... B26D 3/169 222/391
2017/0043367 A1 * 2/2017 Poppe ..... B05C 17/0123
2019/0299244 A1 * 10/2019 Xia ..... B05C 17/0052

* cited by examiner

*Primary Examiner* — Vishal Pancholi
*Assistant Examiner* — Bob Zadeh
(74) *Attorney, Agent, or Firm* — Muncy, Geissler, Olds & Lowe, P.C.

(57) ABSTRACT

A caulking gun is provided, including: a gun body, including a main body, a push mechanism, a driving member movably disposed within the main body and a lever rotatably mounted to the main body to drive the driving member, the push mechanism including a restriction member swingably disposed on the main body and a push rod movably disposed on the main body and disposed through the restriction member; and an adjustment mechanism, mounted to the gun body, being movable to be located in a first position or at least two different other positions; wherein when the adjustment mechanism is located in the first position, the adjustment mechanism contacts the restriction member or the driving member; the adjustment mechanism is distanced by different distances from the restriction member or from the driving member when the adjustment mechanism is located in the at least two different other positions.

7 Claims, 12 Drawing Sheets

CAULKING GUN

BACKGROUND OF THE INVENTION

Field of the Invention

The present invention relates to a caulking gun.

Description of the Prior Art

In a conventional caulking gun, due to the counter force by the pressed a caulking cartridge, there is a long-termed problem of overflow of caulking material from the caulking cartridge after the lever of the conventional caulking gun is released from being pressed. This can be a very important key point in the caulking results. However, the counter force will vary depending on the size of the outlet of the caulking cartridge, thickness of the caulking material and the displacement of the push rod, and the conventional caulking gun cannot effectively respond to the counter force so that the problem of overflow of the caulking material is not solved.

The present invention is, therefore, arisen to obviate or at least mitigate the above-mentioned disadvantages.

SUMMARY OF THE INVENTION

The main object of the present invention is to provide a caulking gun which can avoid overflow of caulking material from a caulking cartridge.

To achieve the above and other objects, the present invention provides a caulking gun, including: a gun body, including a main body, a push mechanism, a driving member and a lever, the push mechanism including a restriction member and a push rod, the restriction member being swingably disposed on the main body, the push rod being movably disposed on the main body and disposed through the restriction member in an axial direction, the driving member being movably disposed within the main body to drive the push rod, the lever being rotatably mounted to the main body to drive the driving member; and an adjustment mechanism, mounted to the gun body, the adjustment mechanism being movable to be located in a first position or at least two different other positions; wherein when the adjustment mechanism is located in the first position, the adjustment mechanism contacts the restriction member or the driving member; the adjustment mechanism is distanced by different distances from the restriction member or from the driving member when the adjustment mechanism is located in the at least two different other positions.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Please refer to FIGS. 1 to 19 for a preferable embodiment of the present invention. A caulking gun 1 of the present invention includes a gun body 10 and an adjustment mechanism 20.

Figure 1:
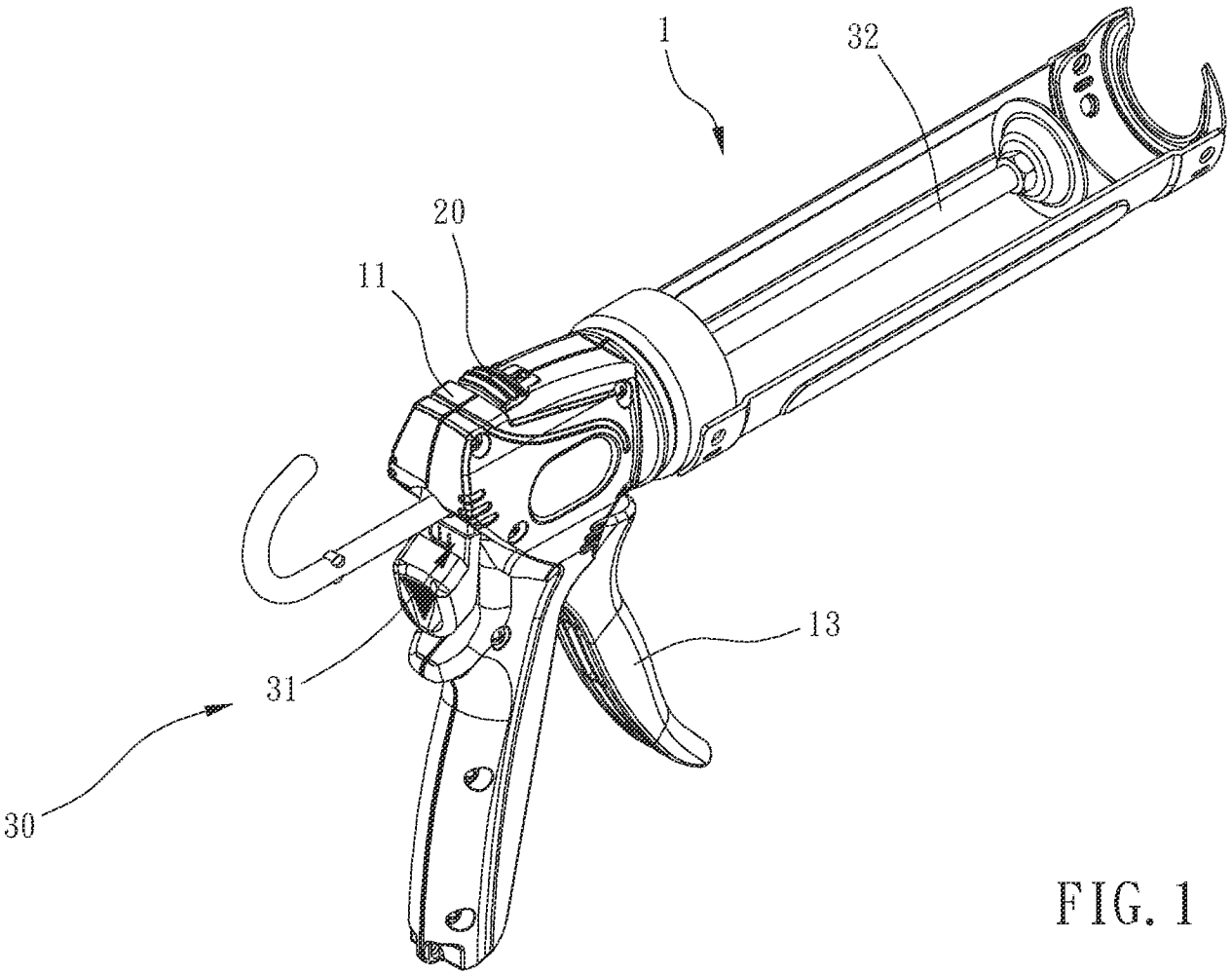
FIG. 1 is a stereogram of a preferable embodiment of the present invention.
Figure 2:
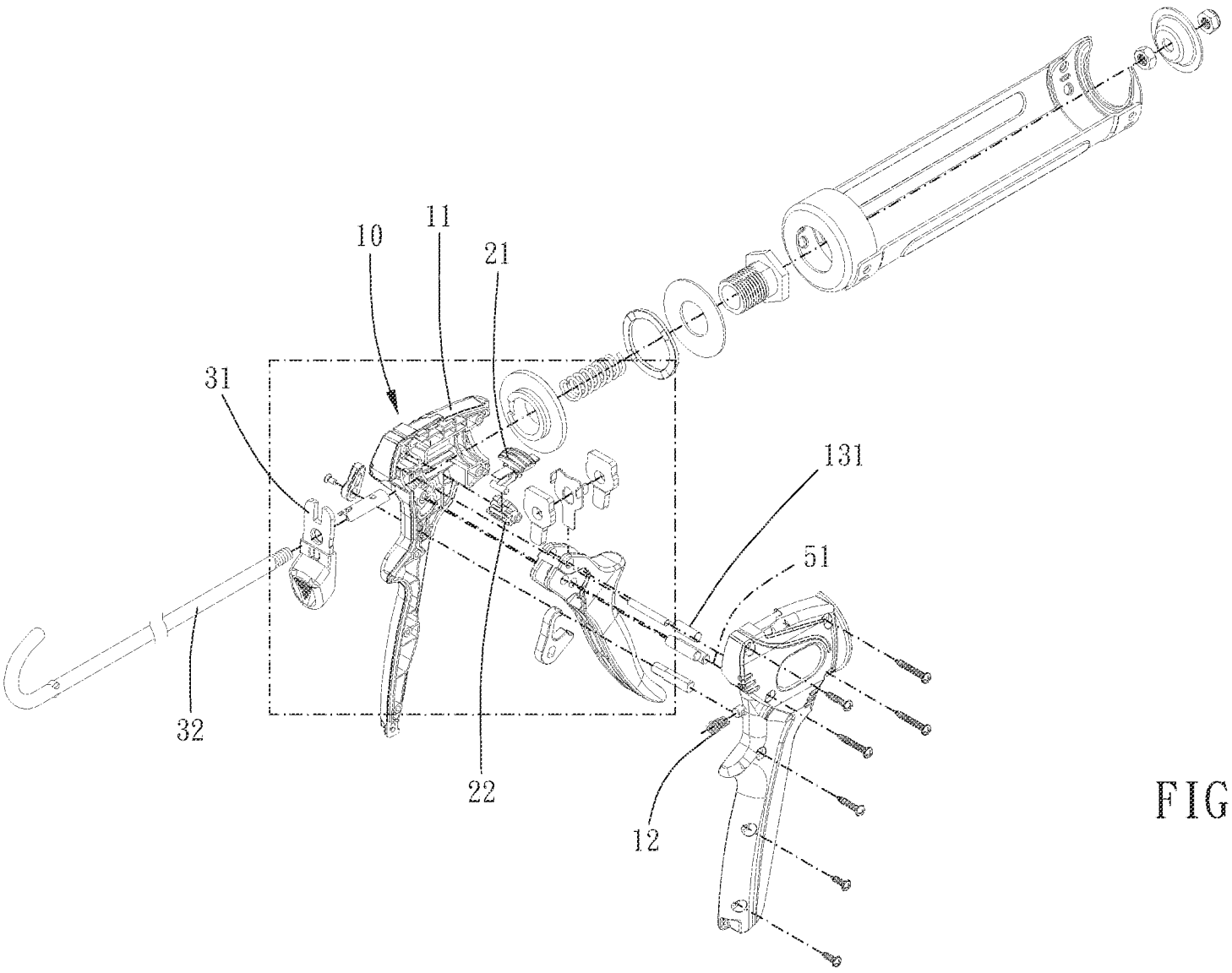
FIG. 2 is a breakdown drawing of a preferable embodiment of the present invention.
Figure 3:
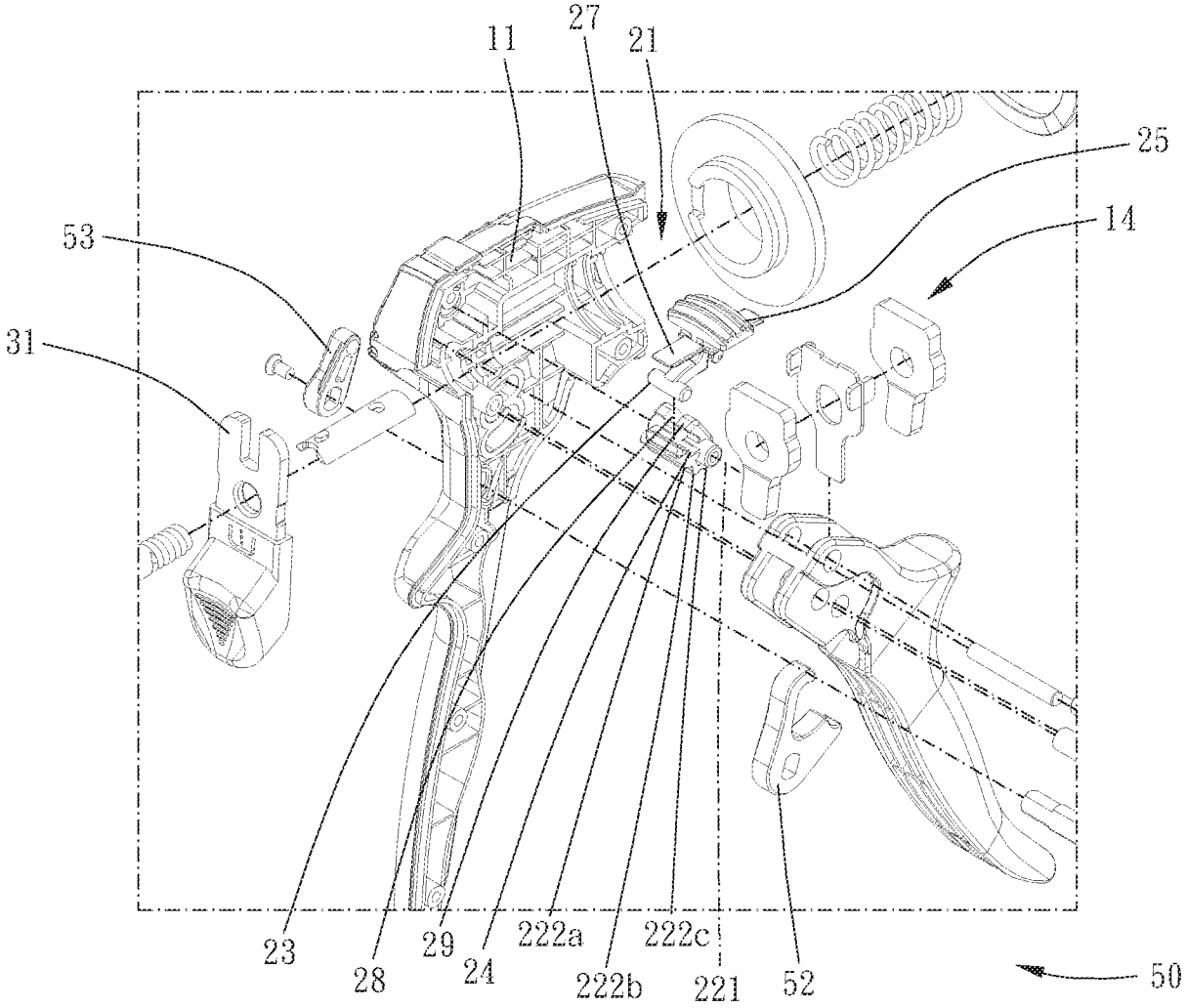
FIG. 3 is a partial enlargement of FIG. 2.
Figures 4, 5:
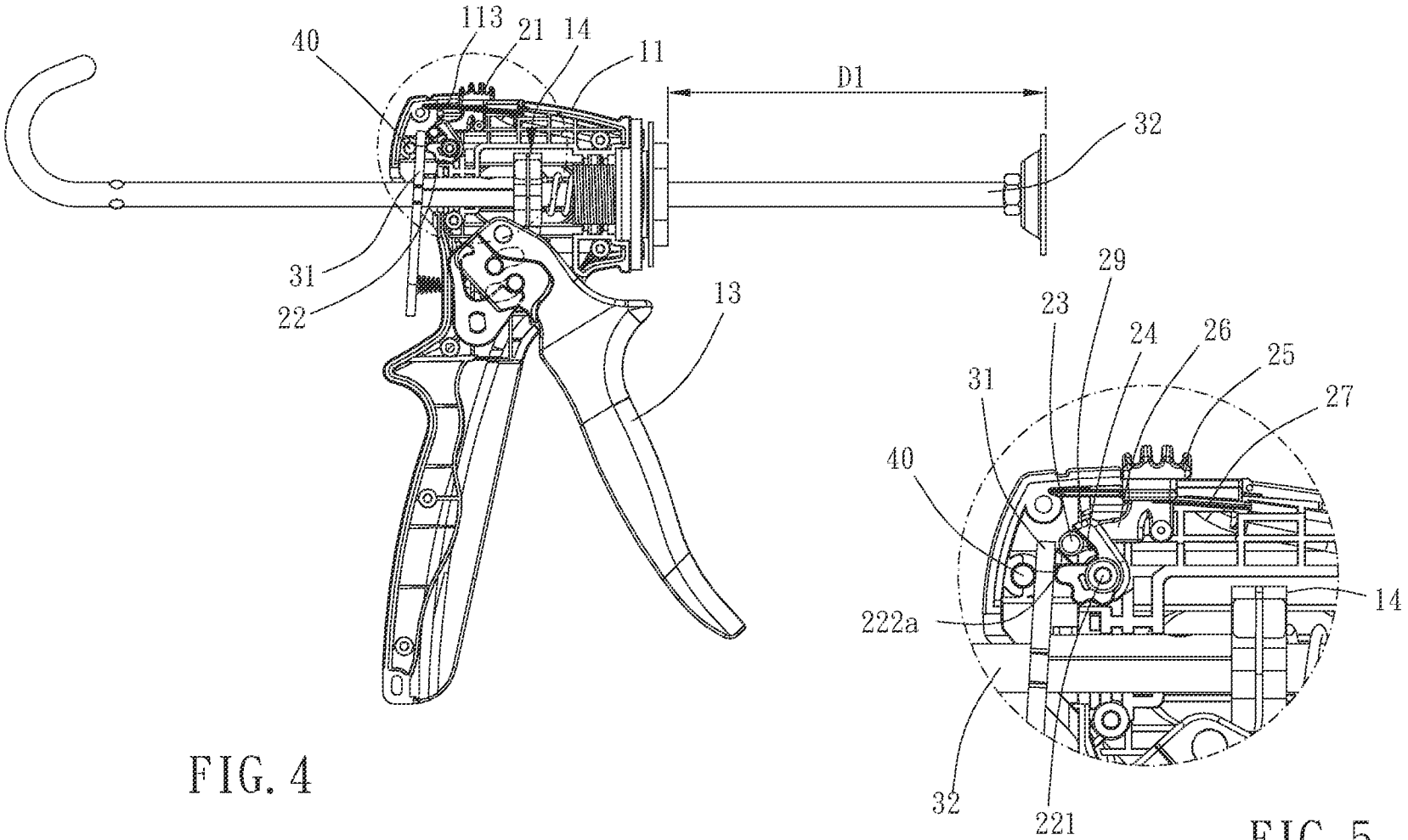
FIG. 4 is a drawing showing an adjustment mechanism in a first position according to a preferable embodiment of the present invention.
FIG. 5 is a partial enlargement of FIG. 4.
Figure 6:
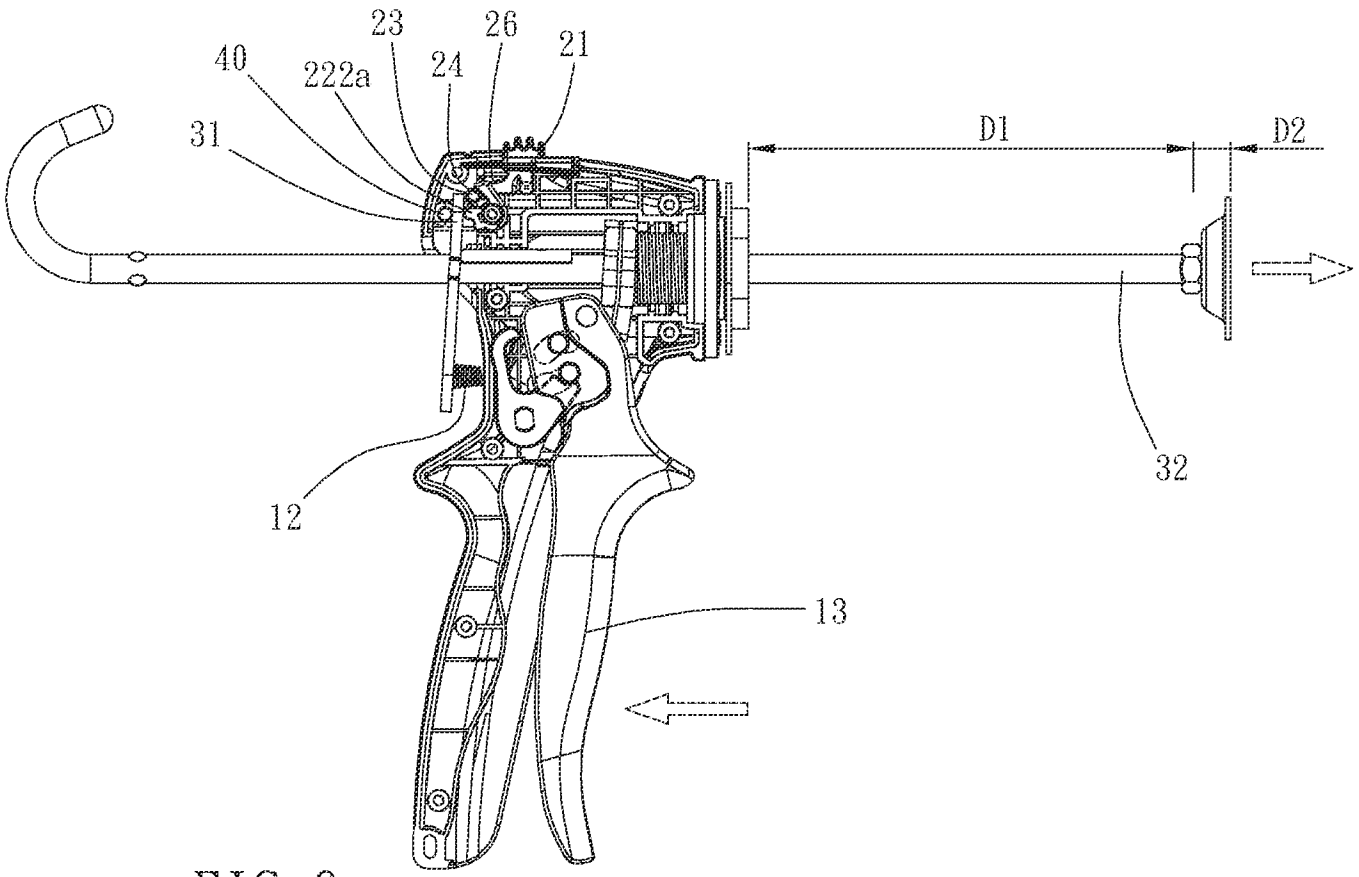
FIGS. 6-7 are drawings showing operation of the adjustment mechanism in the first position according to a preferable embodiment of the present invention.
Figure 7:
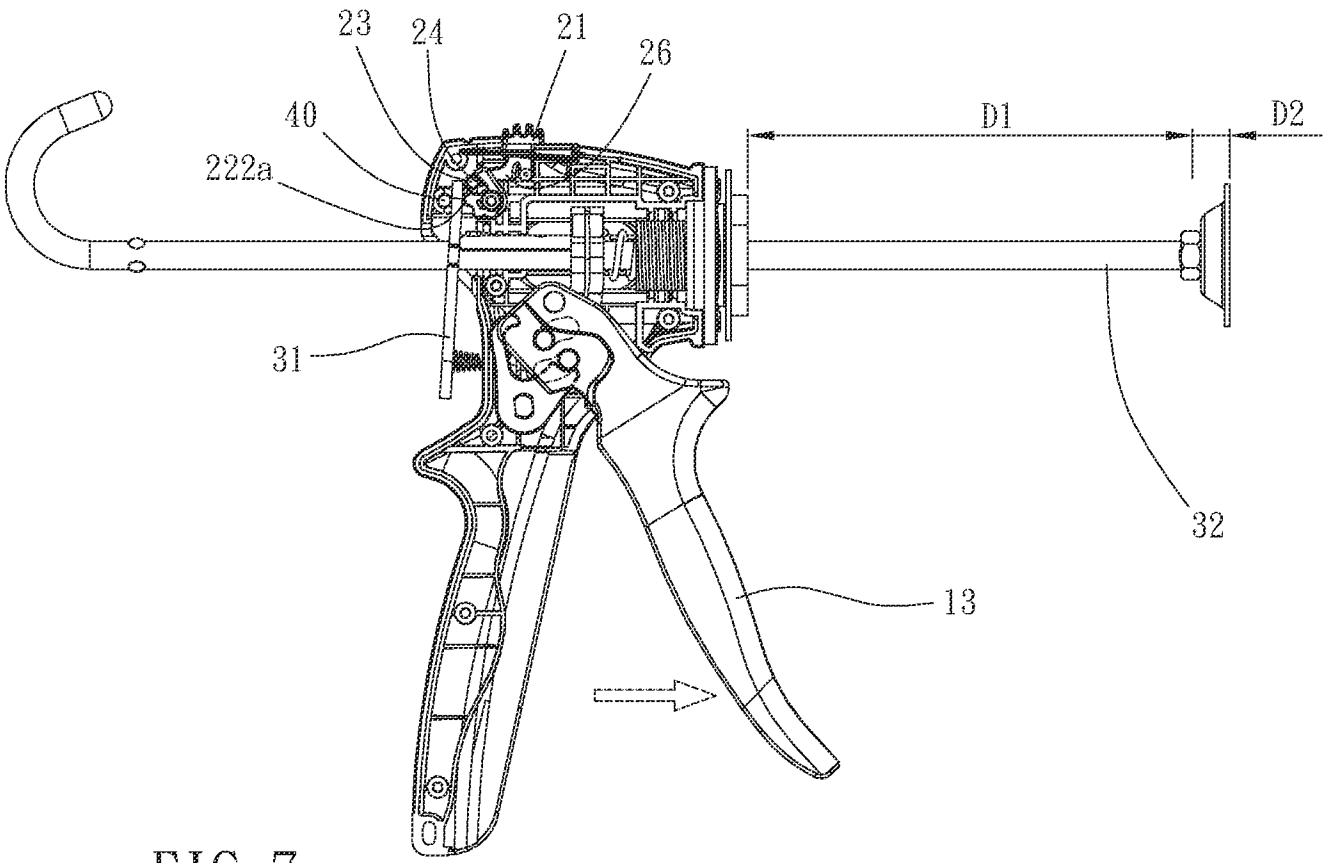
Figures 8, 9:
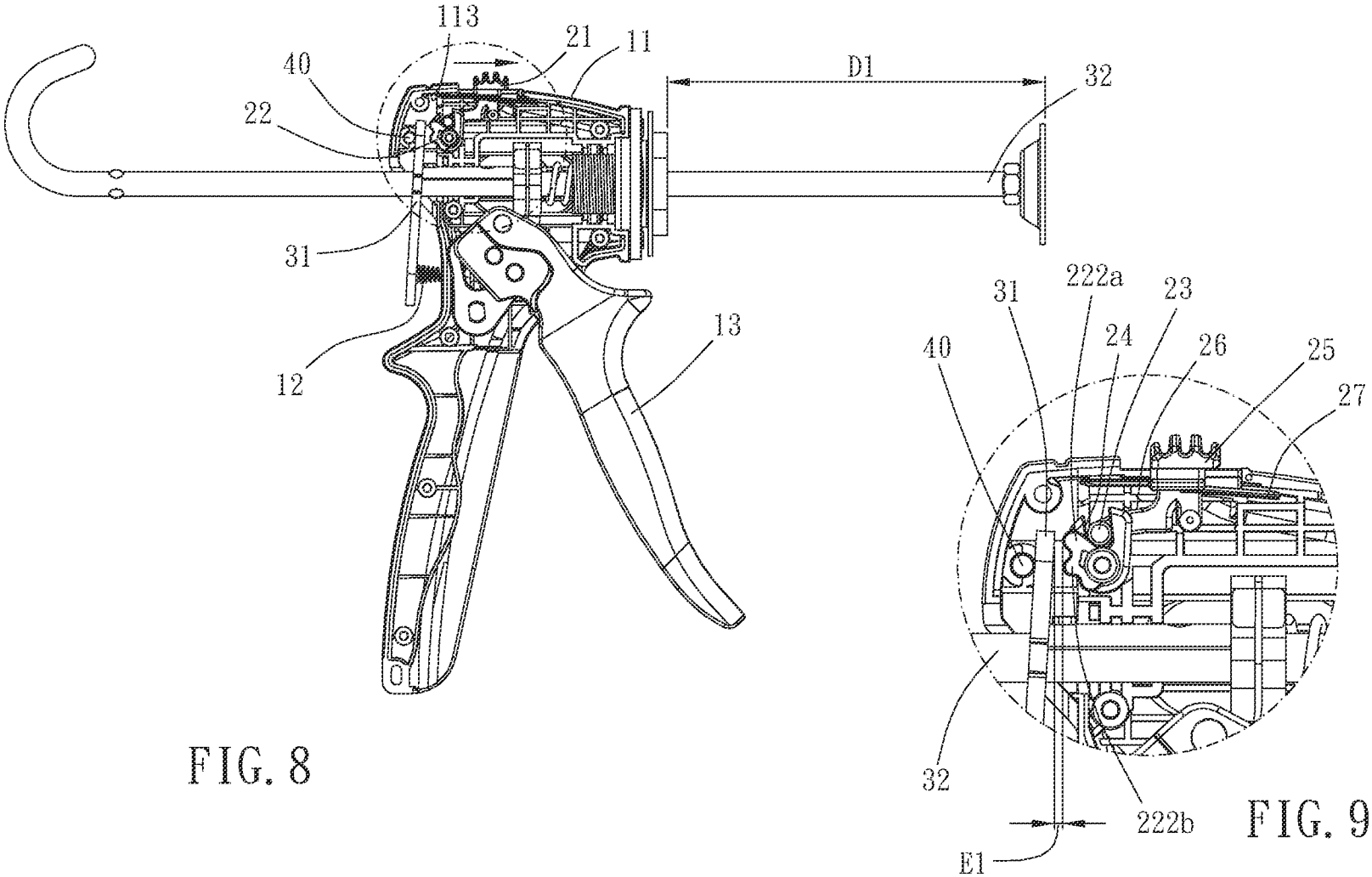
FIG. 8 is a drawing showing the adjustment mechanism in a second position according to a preferable embodiment of the present invention.
FIG. 9 is a partial enlargement of FIG. 8.
Figures 10, 11:
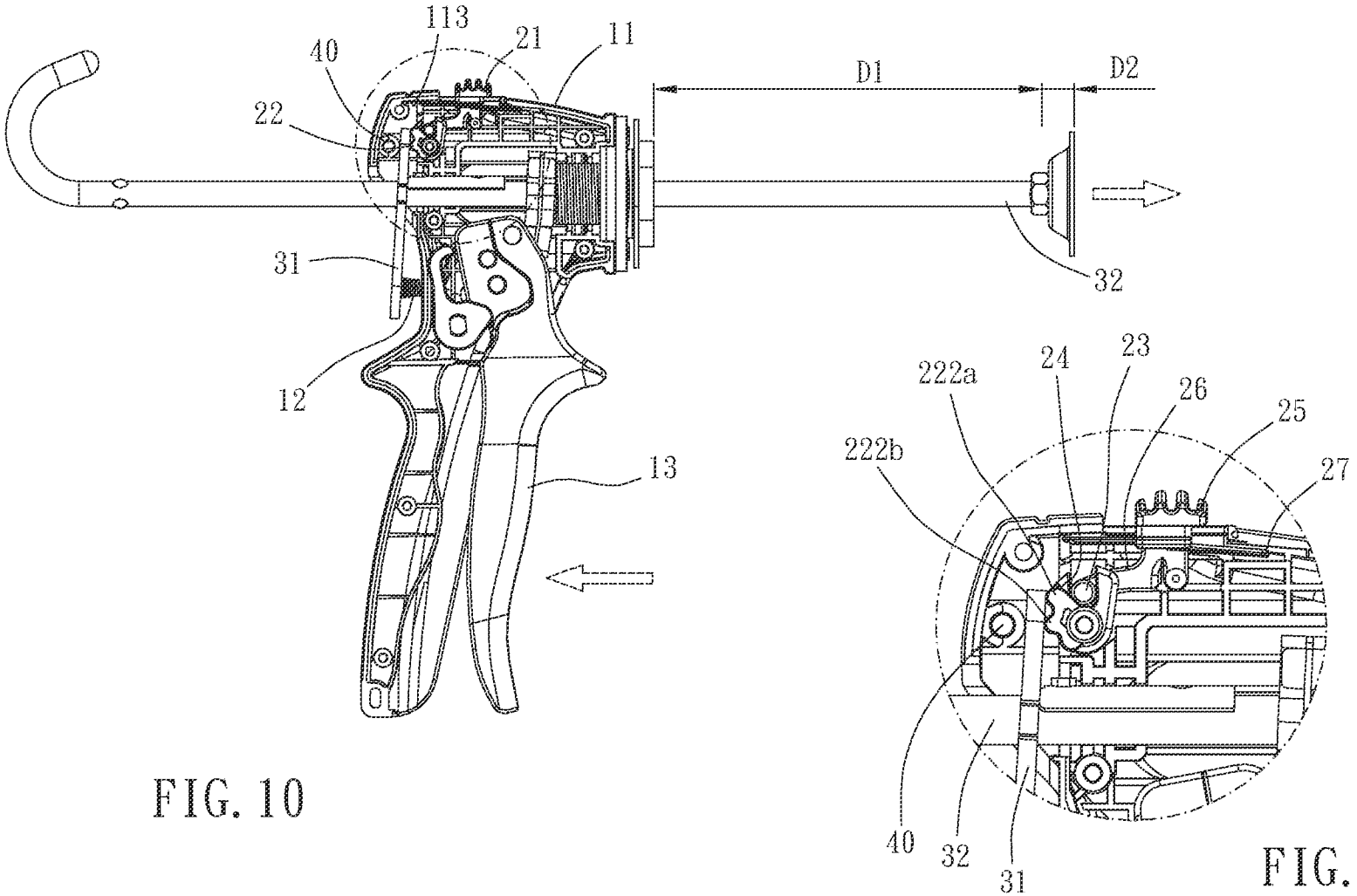
FIG. 10 is a drawing showing operation of the adjustment mechanism in the second position according to a preferable embodiment of the present invention.
FIG. 11 is a partial enlargement of FIG. 10.

The gun body 10 includes a main body 11, a push mechanism 30, an elastic member 12, a driving member 14 and a lever 13, and the push mechanism 30 includes a restriction member 31 and a push rod 32. The restriction member 31 is swingably disposed on the main body 11, the push rod 32 is movably disposed on the main body 11 and disposed through the restriction member 31 in the axial direction A, the driving member 14 is movably disposed within the main body 11 and to drive the push rod 32, and the lever 13 is rotatably mounted to the main body 11 and to drive the driving member 14. The elastic member 12 is abutted between the restriction member 31 and the main body 11. The adjustment mechanism 20 is mounted to the gun body 10 (in this embodiment, mounted to the main body 10). The adjustment mechanism 20 includes a control portion 21 and a limiting portion 22. The control portion 21 is mounted to the main body 11, the limiting portion 22 is movable with the control portion 21, the adjustment mechanism 20 (the control portion 21) is, relative to the push mechanism 30, movable to be located in a first position (FIGS. 4-7) and or at least two different other positions (FIGS. 8-9). When the adjustment mechanism 20 (the control portion 21) is located in the first position, the adjustment mechanism 20 (the limiting portion 22) contacts the restriction member 31 or the driving member 14, for blocking the limiting portion 22 in the axial direction. The adjustment mechanism 20 (the limiting portion 22) is distanced by different distances E1, E2 from the restriction member 31 or from the driving member 14 when the adjustment mechanism 20 (the limiting portion 22) is located in the at least two different other positions. The restriction member 31 is movable with the push rod 32, which can adjust the movement and position of the restriction member 31 on the axial direction A. Whereby, the push rod can be controlled to has multiple stages, to be or not to be pushed backward by the pressed caulking cartridge after the lever 13 which is pressed is released.

The control portion 21 is mounted to the main body 11 and movable in the axial direction A, the control portion 21 operates to drive the limiting portion 22, and the limiting portion 22 is rotatably mounted to the main body 11. One of the control portion 21 and the limiting portion 22 includes a pivot portion 23, the other of the control portion 21 and the limiting portion 22 includes a slot 24, and the pivot portion 23 is movably disposed within the slot 24, wherein the position of the pivot portion 23 within the slot 24 is changed when the control portion 21 drives the limiting portion 22 to move. In this embodiment, the adjustment mechanism 20 is mounted to the main body 11, the control portion 21 includes the pivot portion 23, the limiting portion 22 includes the slot 24, and the slot 24 extends axially and is open toward a radial direction. The control portion 21 includes a control section 25 and a connection section 26, the control section 25 is protrusive out beyond the main body 11, the connection section 26 is connected between the control section 25 and the pivot portion 23, and the connection section 26 is arcuate. The limiting portion 22 can stably block the restriction member 31.

The main body 11 further includes a metal blocking member 40, the metal blocking member 40 and the limiting portion 22 are located at opposing sides of the restriction member 31, and the metal blocking member 40 can block the restriction member 31.

The main body 11 further includes a restriction slot 113, the control portion 21 further includes a restricting section 27, the restricting section 27 is connected between the control section 25 and the connection section 26, and the restricting section 27 is movably inserted within the restriction slot 113 and configured to limit displacement of the control portion 21. The limiting portion 22 further includes a guiding groove 28 in communication with the slot 24, the guiding groove 28 is open toward a direction lateral to a radial direction of the limiting portion 22, and the connection section 26 is movably within the guiding groove 28. The limiting portion 22 further includes two arms 29 arranged in interval further, and the two arms 29 define the guiding groove 28. The two arms 29 are located at opposing sides of the connection section 26 for driving the limiting portion 22 stably.

The limiting portion 22 is rotatable about an axis 221 relative to the main body 11, the limiting portion 22 defines a circumferential direction B around the axis 221, the limiting portion 22 includes a plurality of projections 222*a*, 222*b*, 222*c* arranged along the circumferential direction B, and the plurality of projections 222*a*, 222*b*, 222*c* have different extents. The control portion 21 operates to drive the limiting portion 22 to move so that one of the plurality of projections 222*a*, 222*b*, 222*c* is controlled to correspond to the restriction member 31, wherein the slot 24 and the plurality of projections 222*a*, 222*b*, 222*c* are arranged on the circumferential direction B. Preferably, the plurality of projections 222*a*, 222*b*, 222*c* have different radial extents. With respective ones of the projection 222*a*, 222*b*, 222*c* corresponding to the restriction member 31, the push rod can be controlled to be in different stages, to be or not to be pushed backward by the pressed caulking cartridge after the lever 13 which is pressed is released.

The caulking gun 1 further includes a pivot mechanism 50. The lever 13 includes a push portion 131 abuttable against the driving member, and the pivot mechanism 50 connects the lever 13 and the main body 11. The pivot mechanism 50 has an axial line 51 whose position is changeable, a limitation unit 52, and an operation member 53 which is movable with the limitation unit 52 and is operable from an outside of the gun body 10. The lever 13 is rotatable about the axial line 51 serving as a rotation center C, the limitation unit 52 is adjustably mounted to at least one of the gun body 10 and the lever 13, and the position of the axial line 51 (the rotation center C) is adjustable by operating the operation member 53 to drive the limitation unit 52. The adjustment mechanism 20 is disposed between the driving member 14 and the restriction member 31. As a result, the displacement of the driving member 14 pushed by the push portion 131 when the lever 13 is pressed can be changed, and this provides reference for adjustment of the control portion 21.

Figures 12, 13:
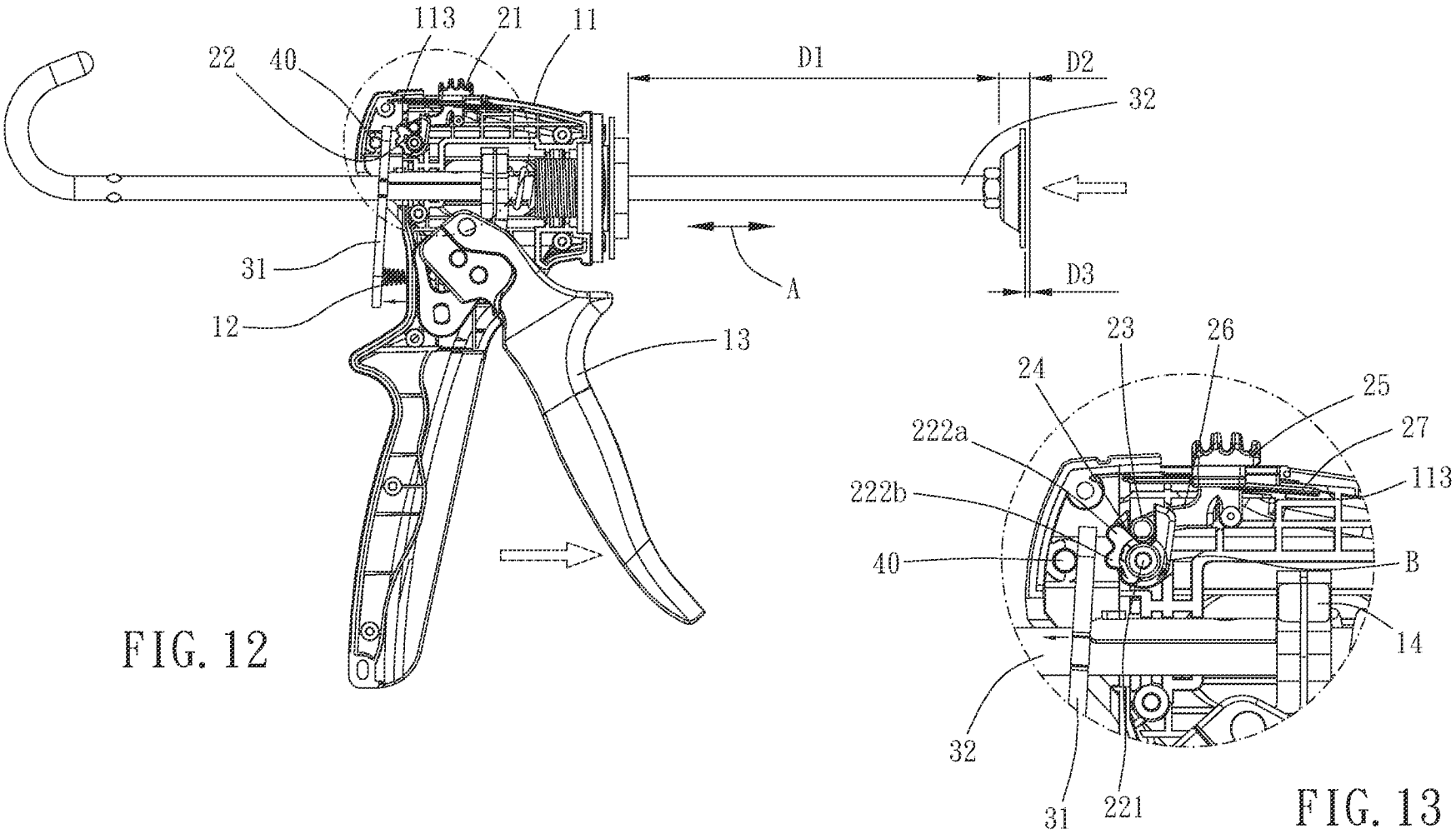
FIG. 12 is a drawing showing the state of a caulking gun with its level is released when the adjustment mechanism is in the second position according to a preferable embodiment of the present invention.
FIG. 13 is a partial enlargement of FIG. 12.
Figures 14, 15:
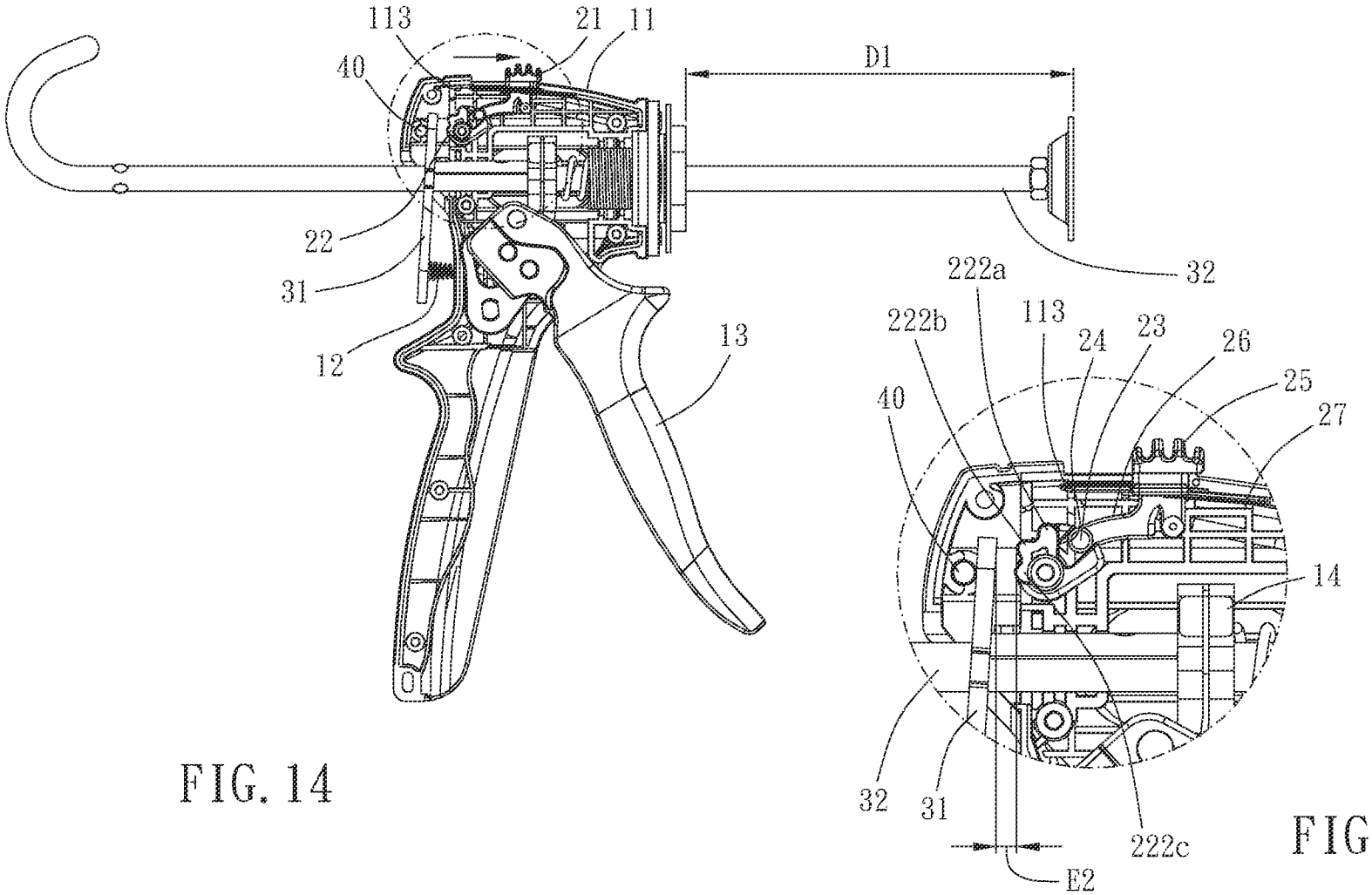
FIG. 14 is a drawing showing the adjustment mechanism in a third position according to a preferable embodiment of the present invention.
FIG. 15 is a partial enlargement of FIG. 14.
Figure 16:
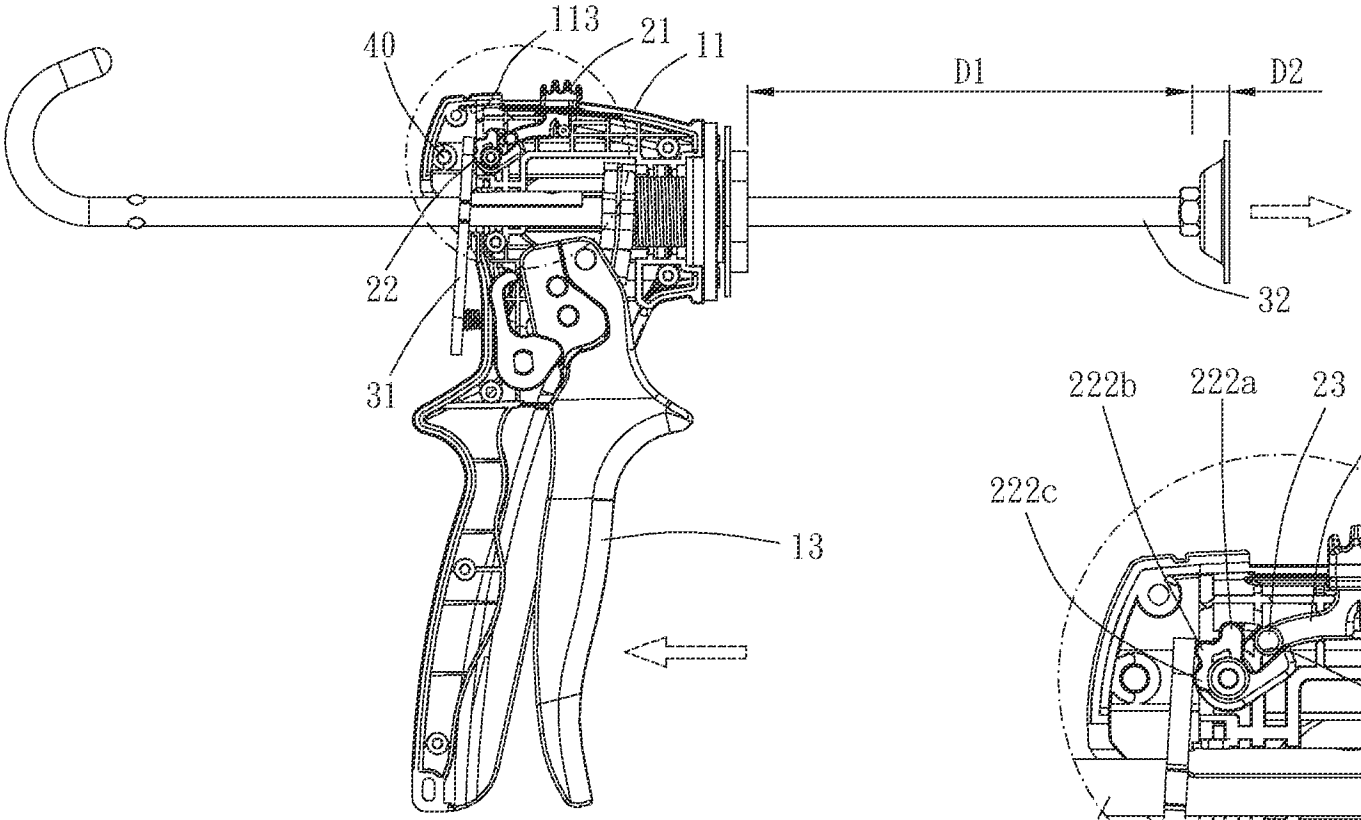
FIG. 16 is a drawing showing the state of a caulking gun with its level is pressed when the adjustment mechanism is in the third position according to a preferable embodiment of the present invention.
Figure 17:
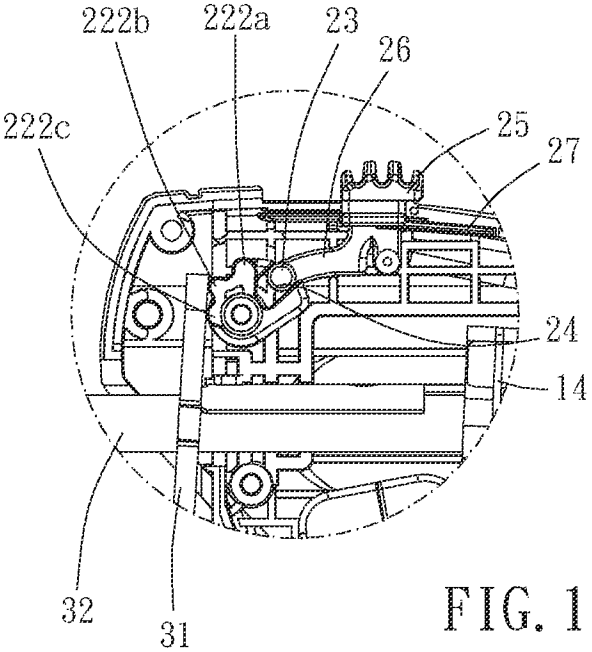
FIG. 17 is a partial enlargement of FIG. 16.
Figure 18:
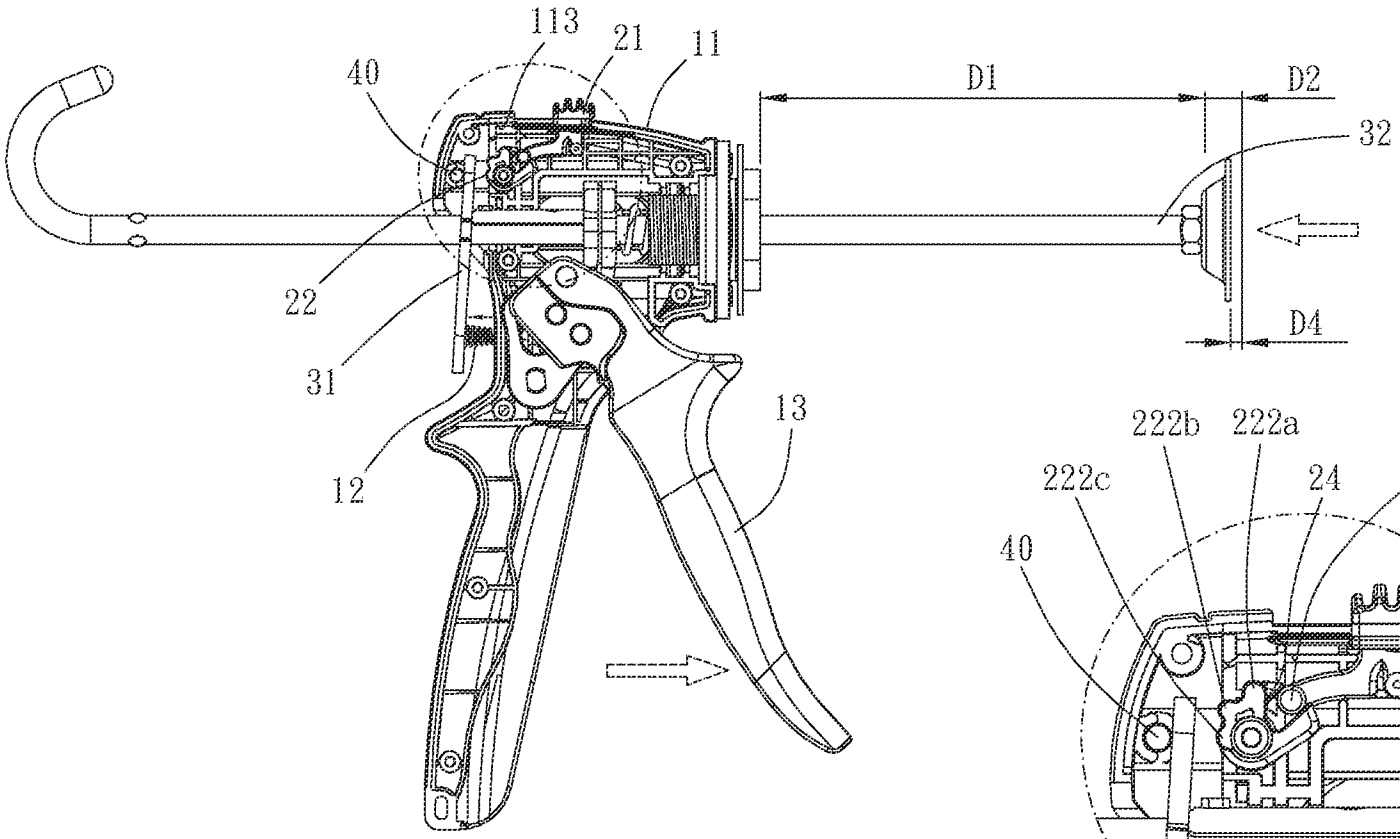
FIG. 18 is a drawing showing the state of the caulking gun with its level is released when the adjustment mechanism is in the third position according to a preferable embodiment of the present invention.
Figure 19:
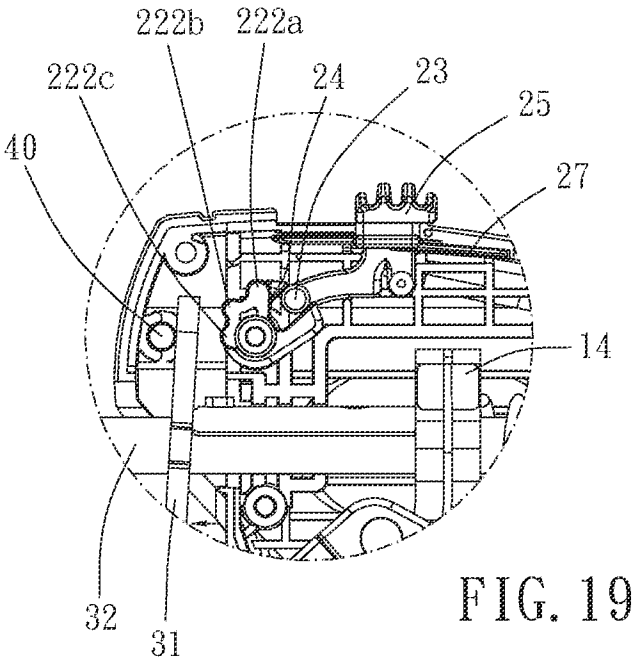
FIG. 19 is a partial enlargement of FIG. 18.

As shown in FIGS. 4-19, a distance from a pushing head 33 disposed on an end of the push rod 32 to the main body 11 is defined as D1, and a traveling distance of the pushing head 33, as the lever 13 is pressed, is defined as D2. The backward displacements of the pushing head 33 are different when the adjustment mechanism is located in the first position or in any of the at least two different other positions. For example, as shown in FIG. 7 (in the first position), the pushing head 33 does not displace backward; as shown in FIGS. 12 and 18 (in the two different other positions), the pushing head 33 displaces backward for distances D3, D4, respectively, wherein the distance D4 is greater than the distance D3, which can release the counter force of the pressed caulking cartridge after the lever 13 is released, thus avoiding overflow from the caulking material in the caulking cartridge.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A caulking gun, including:

a gun body, including a main body, a push mechanism, a driving member and a lever, the push mechanism including a restriction member and a push rod, the restriction member being swingably disposed on the main body, the push rod being movably disposed on the main body and disposed through the restriction member in an axial direction, the driving member being movably disposed within the main body to drive the push rod, the lever being rotatably mounted to the main body to drive the driving member; and an adjustment mechanism, mounted to the gun body, the adjustment mechanism being movable to be located in a first position or at least two different other positions;

wherein when the adjustment mechanism is located in the first position, the adjustment mechanism contacts the restriction member or the driving member; the adjustment mechanism is distanced by different distances from the restriction member or from the driving member when the adjustment mechanism is located in the at least two different other positions;

wherein the adjustment mechanism includes a control portion and a limiting portion, the adjustment mechanism is mounted to the main body, the control portion is mounted to the main body and movable in the axial direction, the control portion operates to drive the limiting portion, the limiting portion contacts the restriction member or the driving member; the limiting portion is distanced by different distances from the restriction member or from the driving member when the adjustment mechanism is located in the at least two different other positions.

2. The caulking gun of claim 1, wherein the limiting portion is rotatably mounted to the main body, one of the control portion and the limiting portion includes a pivot portion, the other of the control portion and the limiting portion includes a slot, and the pivot portion is movably disposed within the slot.

3. The caulking gun of claim 2, wherein the adjustment mechanism is mounted to the main body, the control portion includes the pivot portion, the limiting portion includes the slot, the slot extends axially; the control portion further includes a control section and a connection section, the control section is protrusive out beyond the main body, the connection section is connected between the control section and the pivot portion, and the connection section is arcuate.

4. The caulking gun of claim 1, wherein the limiting portion is rotatably mounted to the main body, the limiting portion is rotatable about an axis relative to the main body, the limiting portion defines a circumferential direction around the axis, the limiting portion includes a plurality of projections arranged along the circumferential direction, the plurality of projections have different extents; the control portion operates to drive the limiting portion to move so that one of the plurality of projections is controlled to correspond to the restriction member.

5. The caulking gun of claim 4, wherein the plurality of projections have different radial extents.

6. The caulking gun of claim 4, wherein the main body includes a restriction slot, the control portion further includes a restricting section, the restricting section is connected between the control section and the connection section, the restricting section is movably inserted within the restriction slot; the control portion includes a pivot portion, the limiting portion includes a slot, and the pivot portion is movably disposed within the slot; the limiting portion further includes a guiding groove in communication with the slot, the guiding groove is open toward a direction lateral to a radial direction of the limiting portion, the connection section is movably within the guiding groove; the limiting portion further includes two arms arranged in interval, the two arms define the guiding groove, the two arms are located at opposing sides of the connection section; the plurality of projections have different radial extents; the slot and the plurality of projections are arranged on the circumferential direction; the main body further includes a metal blocking member, the metal blocking member and the limiting portion are located at opposing sides of the restriction member; the adjustment mechanism is disposed between the driving member and the restriction member; the gun body further includes an elastic member, and the elastic member is abutted between the restriction member and the main body.

7. A caulking gun, including:

a gun body, including a main body, a push mechanism, a driving member and a lever, the push mechanism including a restriction member and a push rod, the restriction member being swingably disposed on the main body, the push rod being movably disposed on the main body and disposed through the restriction member in an axial direction, the driving member being movably disposed within the main body to drive the push rod, the lever being rotatably mounted to the main body to drive the driving member; and an adjustment mechanism, mounted to the gun body, the adjustment mechanism being movable to be located in a first position or at least two different other positions;

wherein when the adjustment mechanism is located in the first position, the adjustment mechanism contacts the restriction member or the driving member; the adjustment mechanism is distanced by different distances from the restriction member or from the driving member when the adjustment mechanism is located in the at least two different other positions;

wherein the caulking gun further includes a pivot mechanism; the lever includes a push portion abuttable against the driving member; the pivot mechanism connects the lever and the main body, the pivot mechanism has an axial line whose position is changeable, a limitation unit and an operation member which is movable with the limitation unit and is operable from an outside of the gun body, the lever is rotatable about the axial line, the limitation unit is adjustably mounted to at least one of the gun body and the lever, the position of the axial line is adjustable by operating the operation member to drive the limitation unit; and the adjustment mechanism is disposed between the driving member and the restriction member.

* * * * *